US007594829B2

(12) United States Patent
Vaden et al.

(10) Patent No.: US 7,594,829 B2
(45) **Date of Patent: *Sep. 29, 2009**

(54) KEYED MODULAR CONNECTION SYSTEM AND ASSOCIATED ADAPTER CABLE

(75) Inventors: Sterling Vaden, Black Mountain, NC (US); Derrick F. Stikeleather, Swannanoa, NC (US); William R. Reynolds, Asheville, NC (US); Sumio Seo, South Wallingford, VT (US); William B. Everette, Asheville, NC (US)

(73) Assignee: Superior Modular Products, Incorporated, Swannanoa, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/008,865

(22) Filed: Jan. 14, 2008

(65) Prior Publication Data

US 2008/0113562 A1 May 15, 2008

Related U.S. Application Data

(63) Continuation of application No. 11/517,827, filed on Sep. 8, 2006, now Pat. No. 7,318,754.

(51) Int. Cl.
*H01R 24/00* (2006.01)

(52) U.S. Cl. ..... 439/676; 439/680

(58) Field of Classification Search ..... 439/676, 439/680, 502

See application file for complete search history.

(56) References Cited

U.S. PATENT DOCUMENTS 4,376,565 A 3/1983 Bird et al.
4,493,951 A * 1/1985 Sanderson et al. ..... 379/28
4,781,626 A 11/1988 Lazarchik
5,125,852 A 6/1992 Archer
5,370,556 A 12/1994 Olsson
5,538,438 A 7/1996 Orlando
6,017,229 A 1/2000 Tulley et al.

(Continued)

FOREIGN PATENT DOCUMENTS

DE 299 05 338 U1 7/1999

OTHER PUBLICATIONS

PCT International Search Report; App. No. PCT/US2007/077862; Mar. 20, 2008.

*Primary Examiner*—Khiem Nguyen
(74) *Attorney, Agent, or Firm*—Carter, Schnedler & Warnock, P.A.

(57) ABSTRACT

A keyed modular connection system including a nonstandard wiring configuration, a plug wired in the preselected nonstandard wiring configuration and including exterior surfaces that define plug recesses, a jack wired in the preselected nonstandard wiring configuration and including interior surface that define jack recesses, plug protrusions extending from the external surfaces of the plug and configured to be received by the jack recesses when the plug is inserted into the jack, jack protrusions extending from the internal surfaces of the jack and configured to be received by the plug recesses when the plug is inserted into the jack, and when a plug not wired in the preselected nonstandard wiring configuration is attempted to be inserted into the jack, the jack protrusions prevent the attempted insertion, and when the plug is attempted to be inserted into a jack not wired in the preselected nonstandard wiring configuration, the plug protrusions prevent the attempted insertion.

25 Claims, 10 Drawing Sheets

U.S. PATENT DOCUMENTS

| | | | | |
|---|---|---|---|---|
| 6,146,207 | A | 11/2000 | Mulot | |
| 6,290,543 | B1 * | 9/2001 | Plummer et al. | 439/639 |
| 6,350,147 | B2 | 2/2002 | Brownell et al. | |
| 6,517,377 | B2 | 2/2003 | Vaden | |
| 6,663,419 | B2 | 12/2003 | Vaden | |
| 6,821,159 | B2 | 11/2004 | Munger, Jr. et al. | |
| 6,852,386 | B2 | 2/2005 | Nadezhdin et al. | |
| 6,960,025 | B2 | 11/2005 | Gurreri | |
| 7,207,724 | B2 | 4/2007 | Gurreri | |
| 7,258,493 | B2 | 8/2007 | Milette | |
| 7,318,754 | B1 * | 1/2008 | Vaden et al. | 439/676 |

* cited by examiner

KEYED MODULAR CONNECTION SYSTEM AND ASSOCIATED ADAPTER CABLE

CROSS-REFERENCE TO RELATED APPLICATIONS

This application is a continuation of U.S. nonprovisional patent application Ser. No. 11/517,827 filed Sep. 8, 2006.

DETAILED DESCRIPTION OF THE INVENTION

Figure 1:
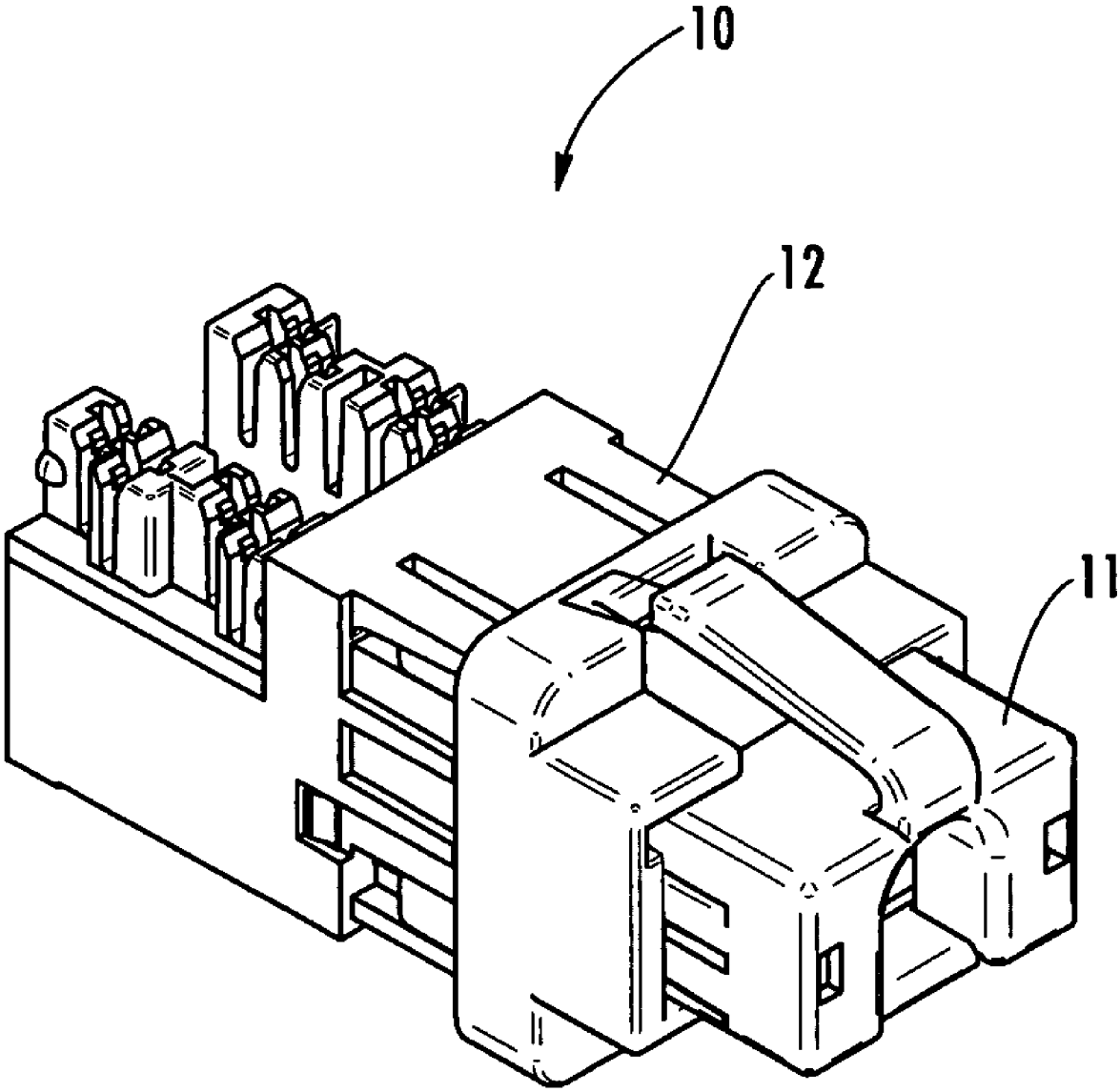
FIG. 1 is a perspective view of a first embodiment of a keyed modular connection system according to the invention, shown fully assembled and with the plug inserted into the jack.
Figure 2:
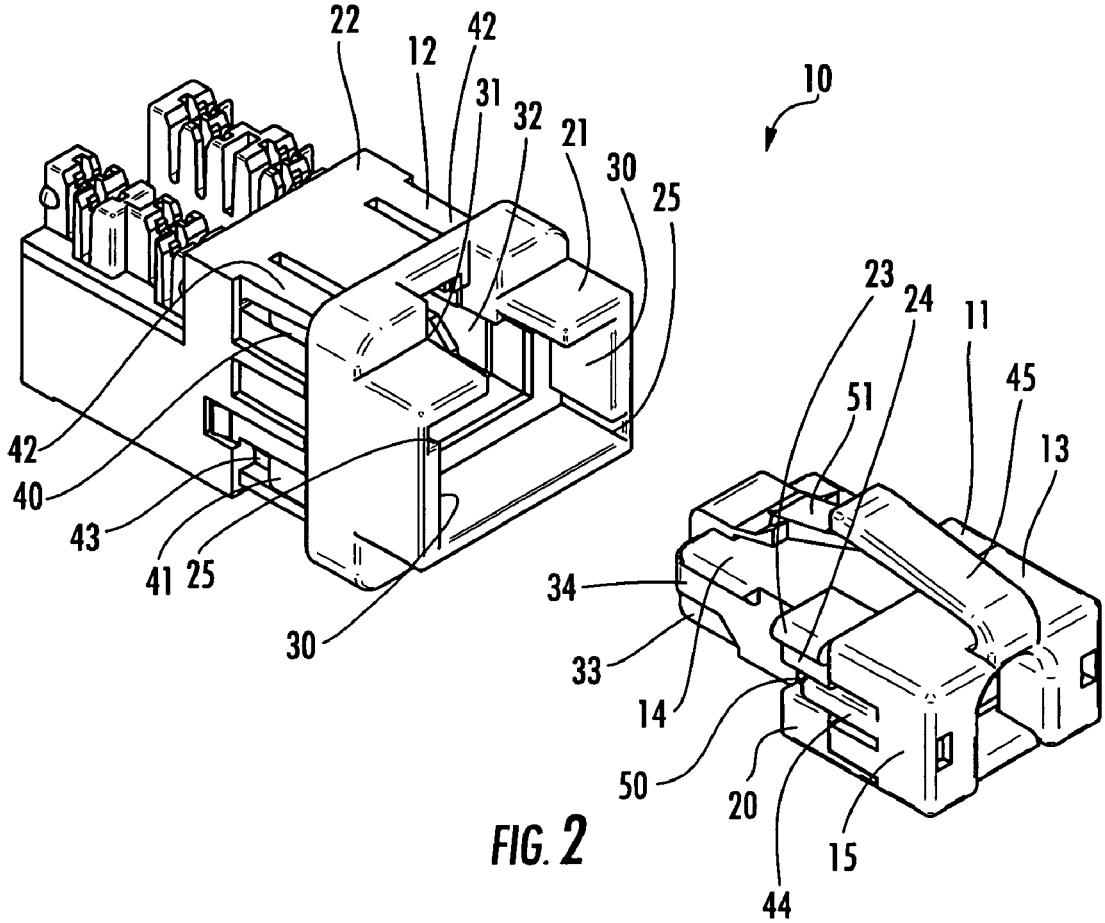
FIG. 2 is a perspective view of the connection system shown in FIG. 1, with the plug and jack separated from one another.
Figure 4:
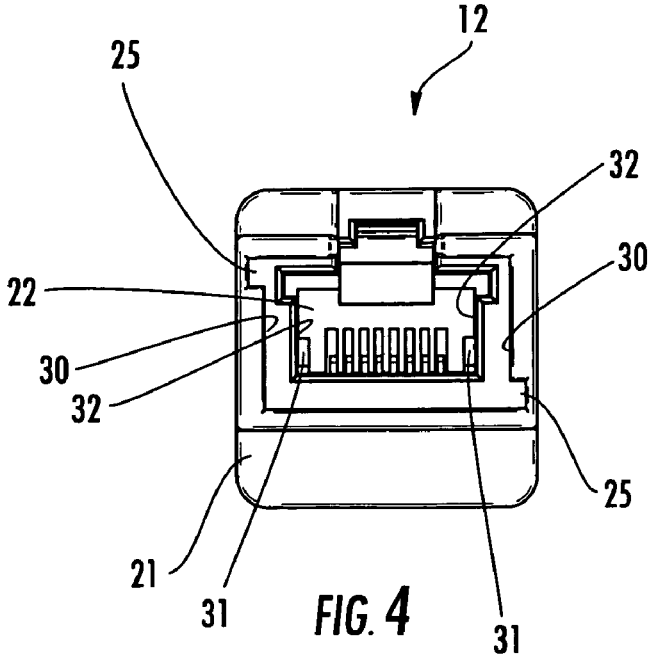
FIG. 4 is an end elevational view into the plug-receiving port of the jack shown in FIGS. 1 and 2.
Figure 3:
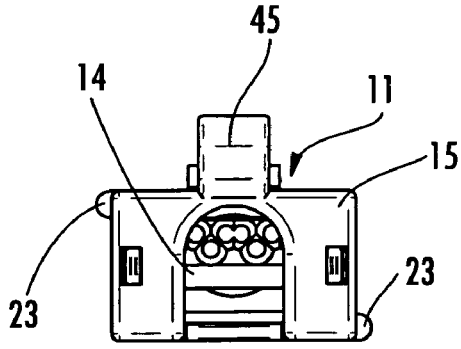
FIG. 3 is an end elevational view into the cable-receiving port of the plug shown in FIGS. 1 and 2.
Figure 5:
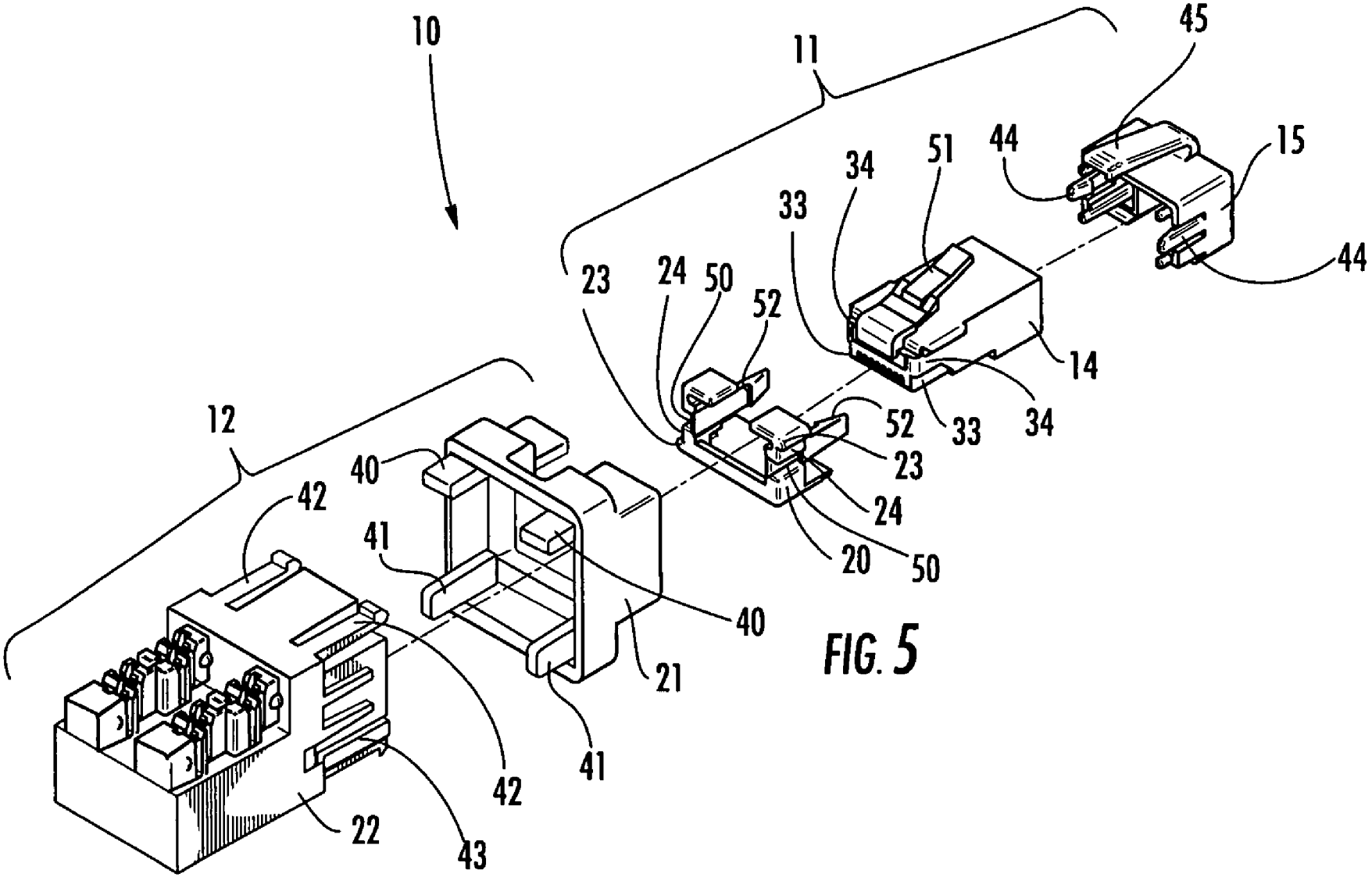
FIG. 5 is an exploded view of the connection system shown in FIGS. 1 and 2.
Figure 6:
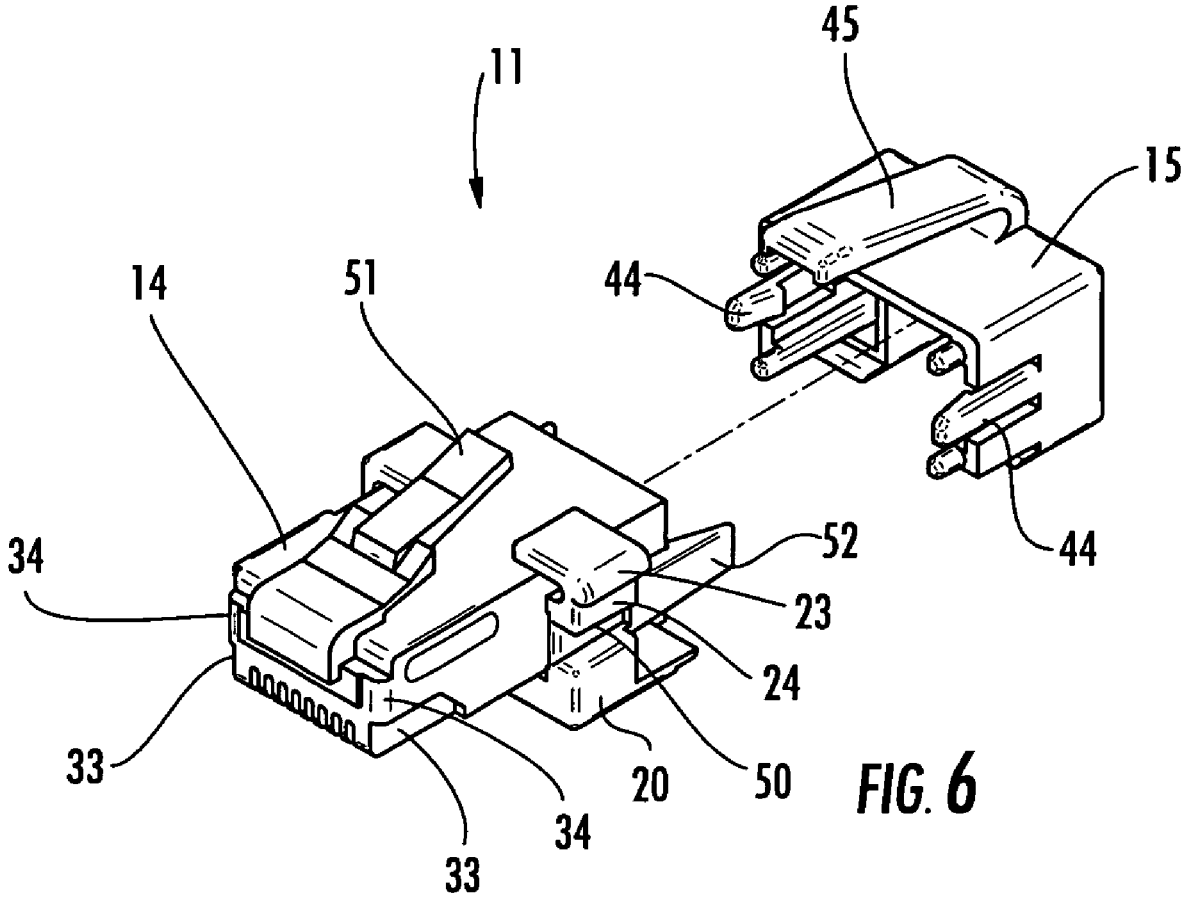
FIG. 6 is a perspective view of the plug shown in FIGS. 1 and 2 with the cap portion of the attachment separated from the remainder of the plug.
Figure 7:
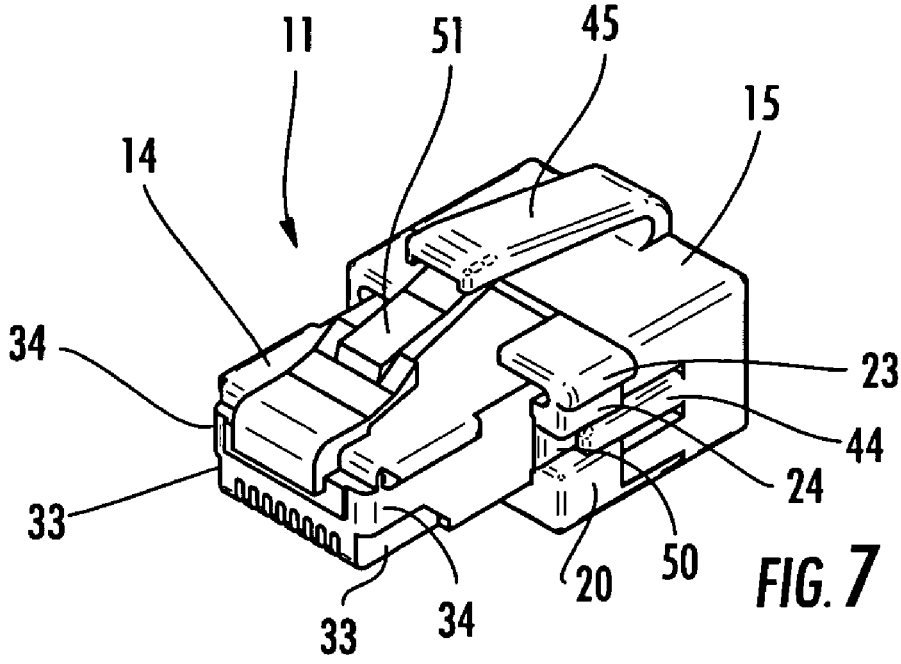
FIG. 7 is a perspective view of the plug shown in FIGS. 1 and 2 as it appears when fully assembled.
Figure 8:
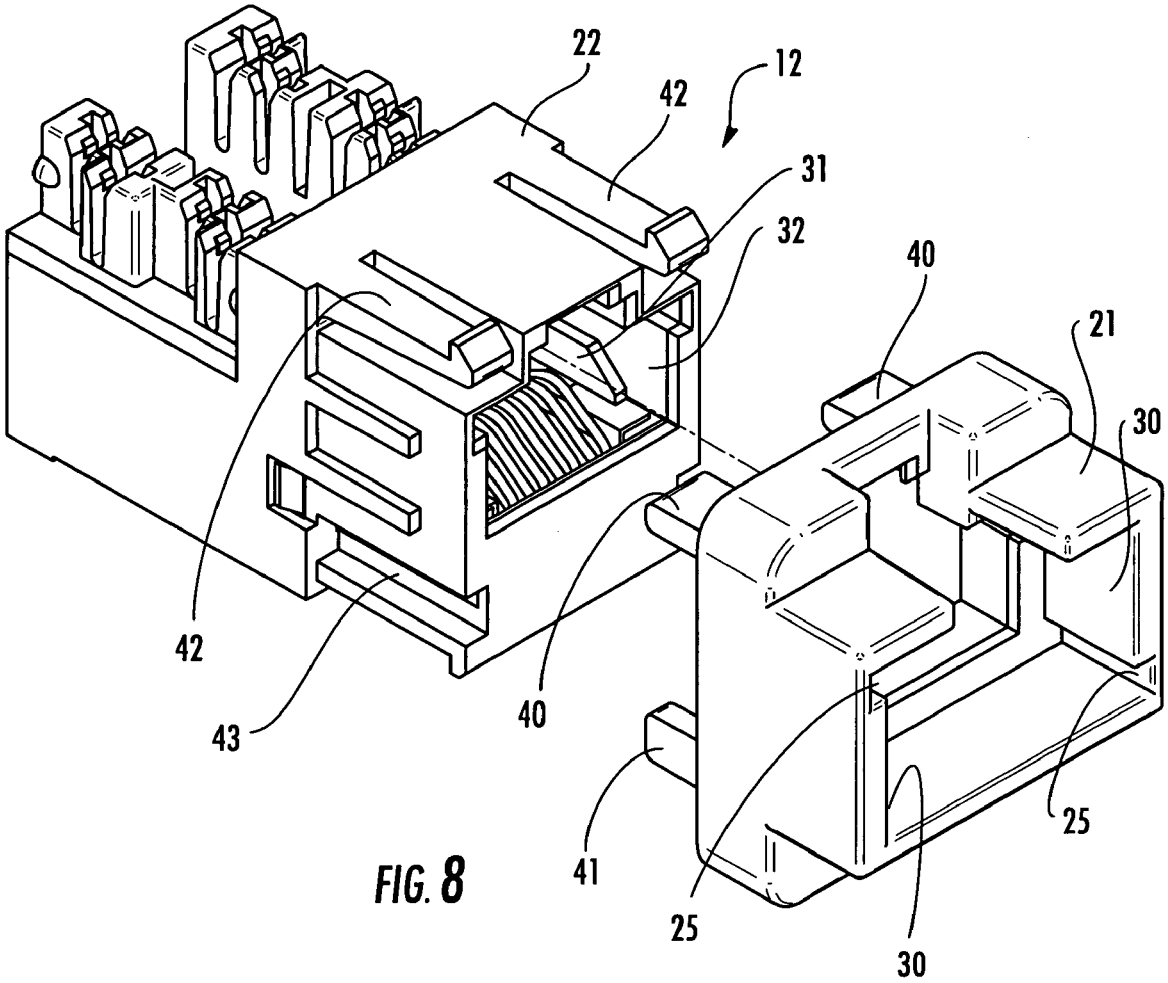
FIG. 8 is an exploded view of the jack shown in FIGS. 1 and 2.
Figure 9:
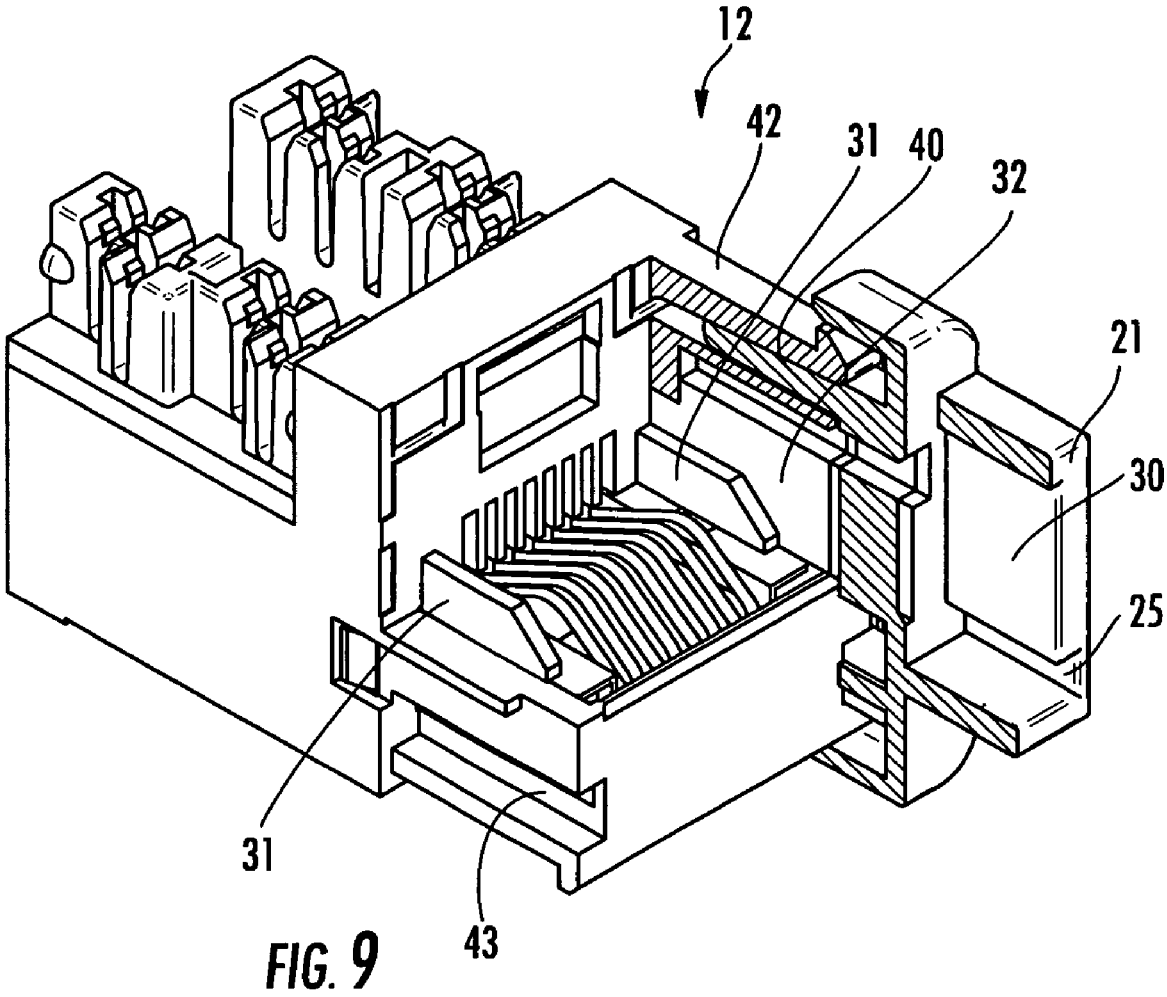
FIG. 9 is a partially cutaway view of the fully assembled jack shown in FIGS. 1 and 2.

A first embodiment of a keyed modular connection system according to the invention is broadly shown fully assembled in FIG. 1 at reference numeral 10. The connection system 10 includes a fully assembled plug 11 and a fully assembled jack 12. FIG. 2 illustrates the fully assembled plug 11 and the fully assembled jack 12 separated from one another, and FIGS. 3 through 9 illustrate further views of the first embodiment of the keyed modular connection system 10 of the invention or components thereof.

The plug 11 comprises an attachment 13 mounted on a plug body 14, and the jack 12 comprises a bezel 21 mounted on a jack body 22. The attachment 13 of the plug 11 comprises a cap 15 and a sleeve 20 for receiving the cap 15. Sleeve protrusions 23 extend from exterior surfaces 24 of the sleeve 20 of the plug 11. Bezel recesses 25 for receiving the sleeve protrusions 23 are defined by interior surfaces 30 of the bezel 21 of the jack 12. Jack body protrusions 31 extend from interior surfaces 32 (FIG. 9) of the jack body 22. Plug body recesses 33 for receiving the jack body protrusions 31 are defined by exterior surfaces 34 of the plug body 14.

Figure 10:
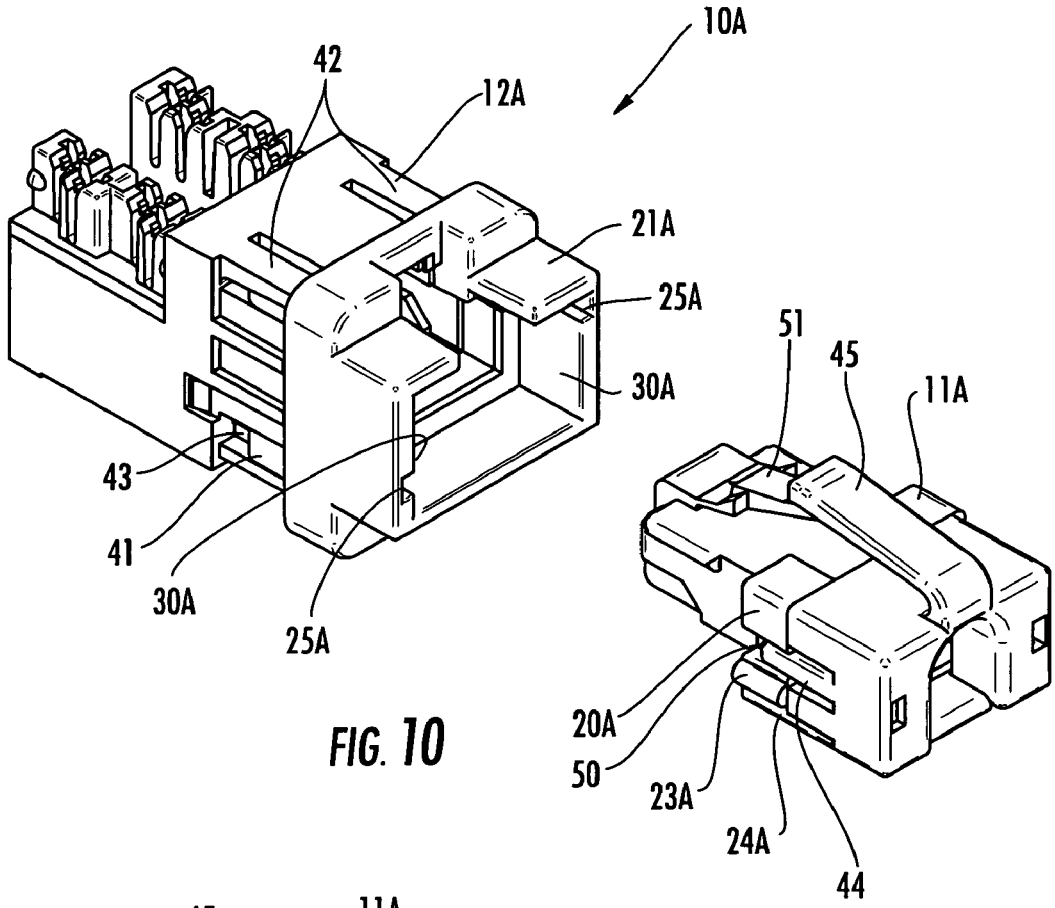
FIG. 10 is a perspective view of a second embodiment of a keyed modular connection system according to the invention, shown fully assembled and with the plug and jack separated from one another.
Figure 11:
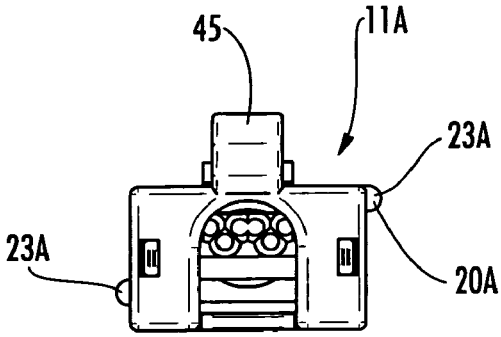
FIG. 11 is an end elevational view into the cable-receiving port of the plug shown in FIG. 10.
Figure 12:
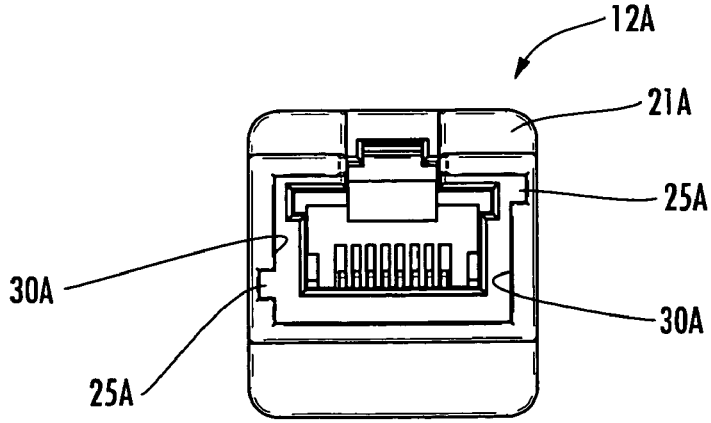
FIG. 12 is an end elevational view into the plug-receiving port of the jack shown in FIG. 10.
Figure 13A:
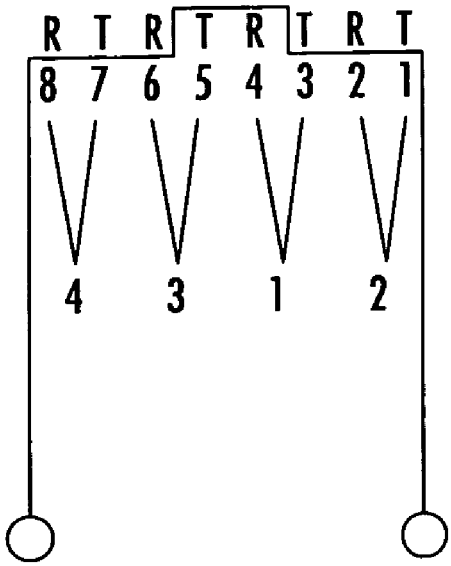
FIGS. 13A, 13B, 13C, and 13D are diagrams of embodiments of nonstandard wiring configurations that may be preselected and implemented in the keyed modular connection system of the invention.
Figure 13B:
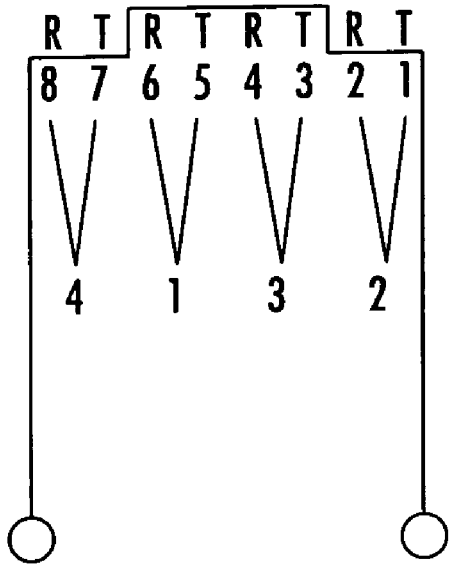
Figure 13C:
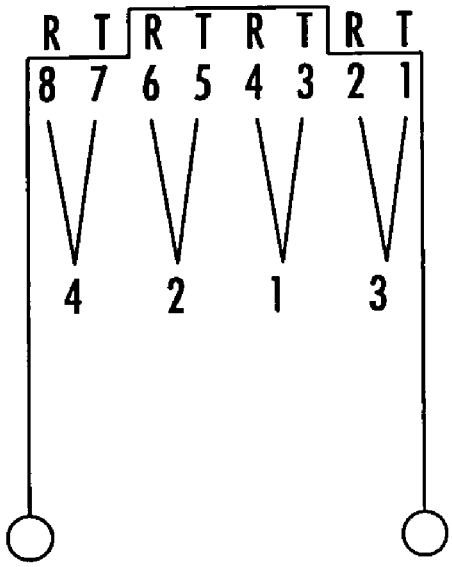
Figure 13D:
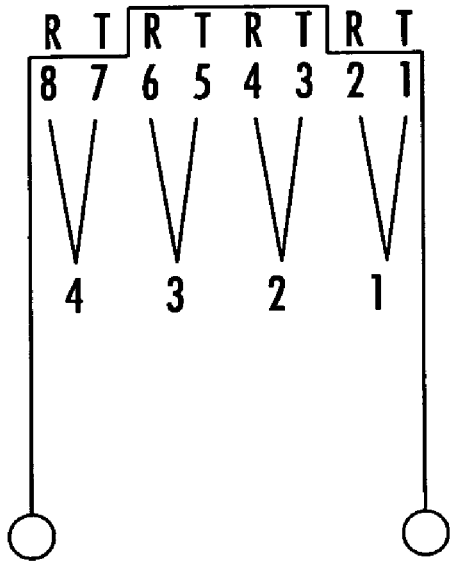

A second embodiment of the keyed modular connection system of the invention is shown broadly at reference numeral 10A in FIG. 10; the plug 1A and jack 12A of this embodiment are shown individually in FIGS. 11 and 12, respectively. In this embodiment, the sleeve protrusions 23A and the bezel recesses 25A are relocated relative to the first embodiment. This difference illustrates that the sleeve protrusions 23A and the bezel recesses 25A may appear in any one of a number of locations on the sleeve 20 and the bezel 21, respectively, so long as they remain in alignment with one another to allow the plug 11A to be received by the jack 12A.

In both embodiments, a pair of upper fingers 40 and a pair of side fingers 41 extend from the bezel 21. When the bezel 21 is installed on the jack body 22, the upper fingers 40 engage clips 42 on the jack body 22, while the side fingers 41 are received by outer recesses 43 defined by the jack body 22. Also in both embodiments, the attachment 13 serves as strain relief relative to pulling forces that may occasionally be imposed on the cabling (not shown) received by the plug 11, 11A. The cap 15 of the attachment 13 comprises a pair of side fingers 44 and an upper finger 45. When the cap 15 is installed on the sleeve 20 and the plug body 14, the pair of side fingers are received by outer recesses 50 defined by the sleeve 20 and the upper finger 45 engages a clip 51 on the plug body 14. Furthermore, the sleeve 20 comprises a pair of side fingers 52 that are received by the cap 15 when the cap 15 is installed on the sleeve 20.

The keyed modular connection system 10, 10A of the invention is designed to enable use of a preselected, nonstandard wiring configuration while assisting with preventing a user from connecting a connector component wired in the preselected, nonstandard wiring configuration to a connector component not wired in the preselected, nonstandard wiring configuration. The connection system 10, 10A thereby provides for the use of nonstandard wiring configurations while assisting with the prevention of the connection of incompatible wiring configurations and the potential damage such connection may cause. The term "nonstandard wiring configuration" as used herein refers to any wiring configuration other than TIA T568A or TIA T568B.

More specifically, the jack body protrusions 31 prevent a plug not wired in the preselected, nonstandard wiring configuration (not shown) from being inserted into the jack 12 of the disclosed embodiment of the invention, which is wired in the preselected, nonstandard wiring configuration; the bezel recesses 25, 25A have no function in this scenario, as the noncompliant plug may be inserted past them. The sleeve protrusions 23, 23A prevent the plug 11 of the disclosed embodiment of the invention, which is wired in the preselected, nonstandard wiring configuration, from being inserted into a jack not wired in the preselected, nonstandard wiring configuration (not shown); the plug body recesses 33 have no function in this scenario, as the noncompliant jack has no jack body protrusions 31 to be received by the plug body recesses 33 and in any event the plug 11 would be prevented from being inserted far enough into the noncompliant jack for the plug body recesses 33 to come into play.

The keyed modular connection system 10, 10A of the invention helps to enable safe implementation and use of any one of a number of nonstandard wiring configurations. Nonstandard wiring configurations may help provide improved connector performance, for instance by reducing crosstalk.

FIGS. 13A, 13B, 13C, and 13D each illustrate an embodiment of a nonstandard wiring configuration that may be preselected and implemented in the keyed modular connection system 10, 10A of the invention. In FIGS. 13A, 13B, 13C, and 13D, the eight conductors in standard four-twisted-pair cable are numbered "1" through "8" from right to left with a designation of each conductor as a tip "T" or ring "R" conductor. The pairs of conductors are numbered "1" through "4" in each illustrated configuration; the primary differences among the illustrated configurations are these conductor pair numberings. For instance, while conductors "1" and "2" comprise conductor pair "2" in the configurations shown in FIGS. 13A and 13B, the same conductors comprise conductor pair "3" in FIG. 13C and conductor pair "1" in FIG. 13D.

Figure 14:
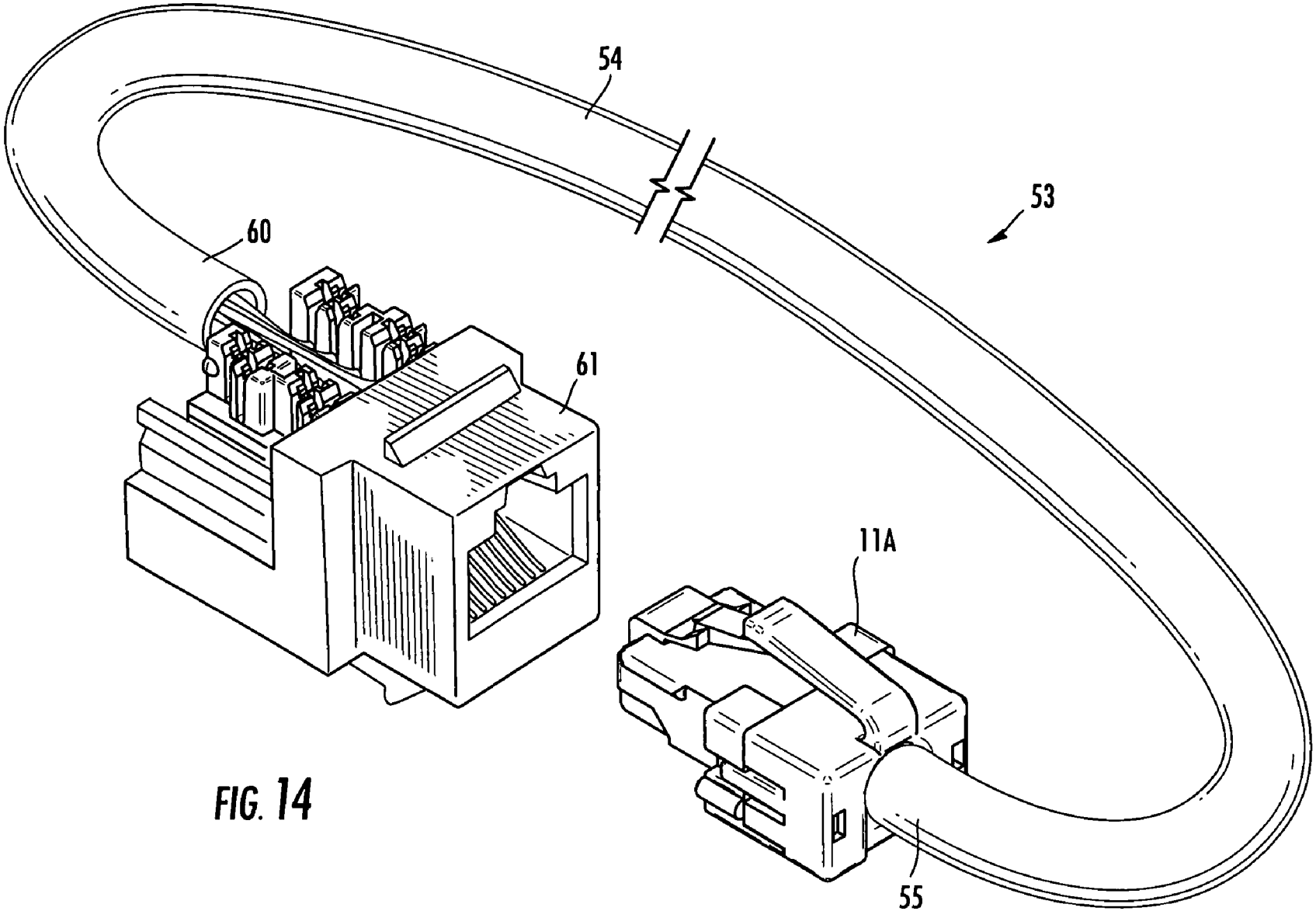
FIG. 14 is a fragmentary perspective view of an embodiment of an adapter cable according to the invention.
Figure 15:
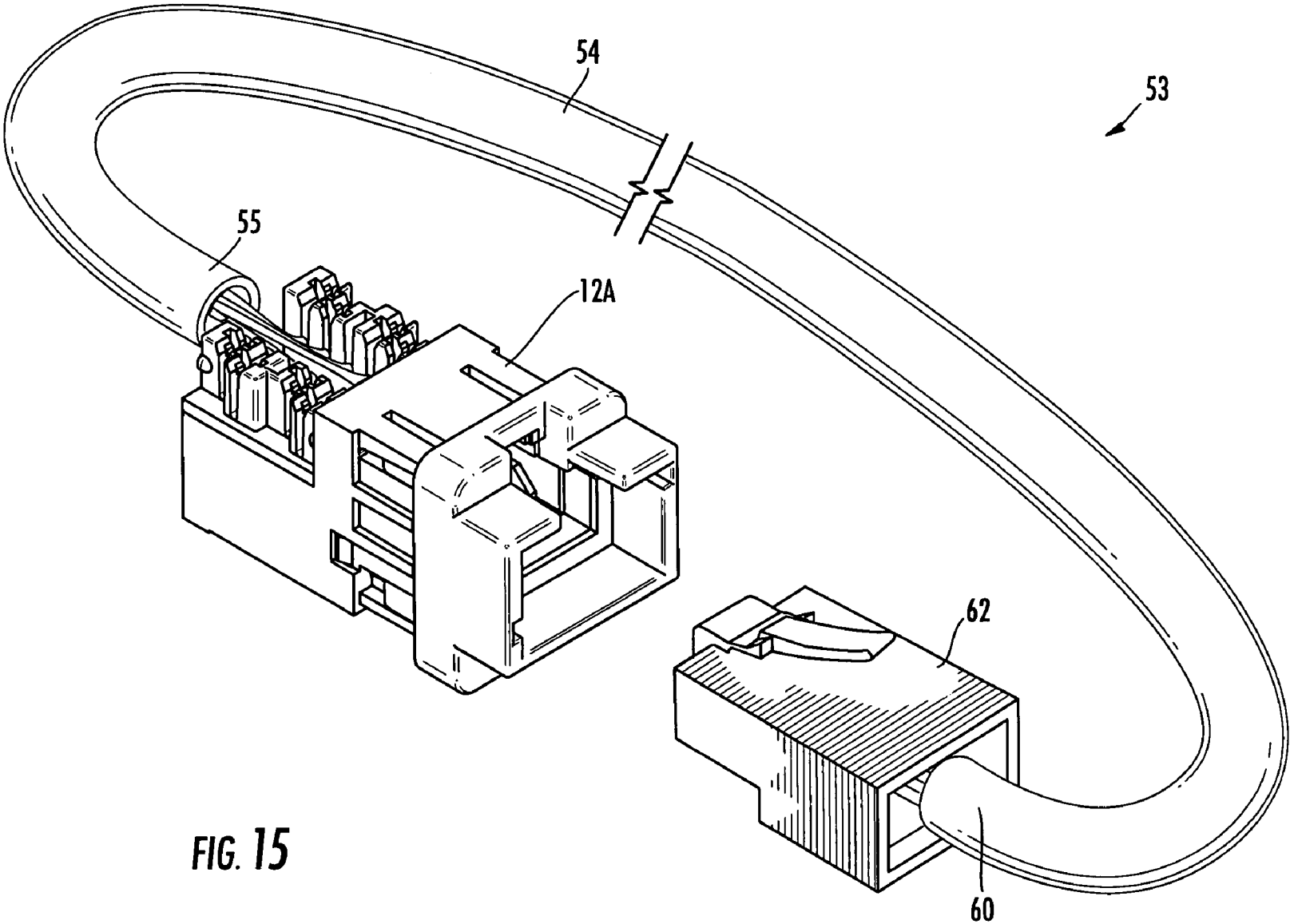
FIG. 15 is a fragmentary perspective view of another embodiment of an adapter cable according to the invention.

As shown in FIGS. 14 and 15, the invention further encompasses an adapter cable 53 to enable the user to transition between the preselected, nonstandard wiring configuration implemented in the keyed modular connection system 10, 10A of the invention and a wiring configuration other than the preselected, nonstandard wiring configuration. The adapter cable 53 is a length of cable 54 with first and second opposing ends 55, 60. The plug 11, 11A or the jack 12, 12A of the keyed modular connection system 10, 10A of the invention is attached to the first end 55 of the length of cable 54, and attached to the second end 60 of the length of cable 54 is a plug or jack not wired in the preselected, nonstandard wiring configuration implemented in the plug 11, 11A or the jack 12, 12A attached to the first end 55 of the length of cable 54. Thus, there are four embodiments of the adapter cable: a first embodiment (FIG. 14) with the plug 11, 11A (shown as 11A) attached to the first end 55 of the length of cable 54 and a jack 61 not wired in the preselected, nonstandard wiring configuration of the plug 11, 11A attached to the second end 60 of the length of cable 54, a second embodiment (not shown) with the plug 11, 11A attached to the first end of the length of cable and a plug not wired in the preselected, nonstandard wiring configuration of the plug 11, 11A attached to the second end of the length of cable, a third embodiment (not shown) with the jack 12, 12A attached to the first end of the length of cable and a jack not wired in the preselected, nonstandard wiring configuration of the jack 12, 12A attached to the second end of the length of cable, and a fourth embodiment (FIG. 15) with the jack 12, 12A (shown as 12A) attached to the first end 55 of the length of cable 54 and a plug 62 not wired in the preselected, nonstandard wiring configuration of the jack 12, 12A attached to the second end 60 of the length of cable 54.

A keyed modular connection system and associated adapter cable are described above. Various details of the invention may be changed without departing from its scope. Furthermore, the foregoing description of embodiments of the invention and the best mode for practicing the invention are provided for the purpose of illustration only and not for the purpose of limitation—the invention being defined by the claims.

What is claimed is:

1. A modular connection system, comprising:

a plug assembly and a jack assembly; said plug assembly including a plug body wired in a preselected nonstandard wiring configuration; said jack assembly including a jack body wired in said preselected nonstandard wiring configuration;

a plug protrusion extending from a surface of said plug assembly for preventing said plug body from being inserted into a jack not wired in said preselected nonstandard wiring configuration;

a jack protrusion extending from a surface of said jack assembly for preventing a plug not wired in said preselected nonstandard wiring configuration from being inserted into said jack body.

2. A modular connection system as set forth in claim 1, wherein said jack body and said plug body each include an ordered array of first, second, third, fourth, fifth, sixth, seventh and eighth conductors, including first, second, third, and fourth conductor pairs.

3. A modular connection system as set forth in claim 2, wherein said preselected nonstandard wiring configuration is defined by said first and second conductors being said second conductor pair, said third and fourth conductors being said first conductor pair, said fifth and sixth conductors being said third conductor pair, and said seventh and eighth conductors being said fourth conductor pair.

4. A modular connection system as set forth in claim 2, wherein said preselected nonstandard wiring configuration is defined by said first and second conductors being said second conductor pair, said third and fourth conductors being said third conductor pair, said fifth and sixth conductors being said first conductor pair, and said seventh and eighth conductors being said fourth conductor pair.

5. A modular connection system as set forth in claim 2, wherein said preselected nonstandard wiring configuration is defined by said first and second conductors being said third conductor pair, said third and fourth conductors being said first conductor pair, said fifth and sixth conductors being said second conductor pair, and said seventh and eighth conductors being said fourth conductor pair.

6. A modular connection system as set forth in claim 5, wherein said preselected nonstandard wiring configuration is defined by said first and second conductors being said first conductor pair, said third and fourth conductors being said second conductor pair, said fifth and sixth conductors being said third conductor pair, and said seventh and eighth conductors being said fourth conductor pair.

7. A modular connection system as set forth in claim 1, wherein said surface of said plug assembly is an exterior surface.

8. A modular connection system as set forth in claim 1, wherein said surface of said jack assembly is an interior surface.

9. A connector comprising:

a jack assembly, including a jack body; said jack body wired in a preselected nonstandard wiring configuration;

a jack protrusion extending from the surface of said jack assembly for preventing the insertion of a plug not wired in said preselected nonstandard wiring configuration into said jack body.

10. A connector as set forth in claim 9 wherein said jack assembly includes a bezel attached to said jack body; said bezel having a recess for receiving a protrusion which extends from the surface of a plug assembly which includes a plug wired in said preselected nonstandard wiring configuration.

11. A connector comprising:

a plug assembly, including a plug body; said plug body wired in a preselected nonstandard wiring configuration;

a plug protrusion extending from the surface of the plug assembly for preventing the insertion of said plug into a jack which is not wired in said preselected nonstandard wiring configuration.

12. A connector as set forth in claim 11, wherein said plug assembly includes a sleeve attached to said plug body; said sleeve having a protrusion receivable in a recess in the surface of a jack assembly which includes a jack body wired in said preselected nonstandard wiring configuration.

13. A connector comprising:

a jack assembly including a jack body; said jack body wired in a preselected nonstandard wiring configuration;

said jack assembly being keyed so as to prevent the insertion of a plug not wired in said preselected nonstandard wiring configuration into said jack body.

14. A connector as set forth in claim 13, wherein said jack body being the portion of said jack assembly which is keyed.

15. A connector assembly as set forth in claim 13, wherein said jack assembly includes a bezel; said bezel being attached to said jack body; said bezel also being keyed so as to permit the insertion of a plug body which is wired in said preselected nonstandard wiring configuration into said jack body.

16. A connector comprising:

a plug assembly, including a plug body; said plug body wired in a preselected nonstandard wiring configuration;

said plug assembly being keyed so as to prevent the insertion of said plug body into a jack which is not wired in a preselected nonstandard wiring configuration.

17. A connector as set forth in claim 16, wherein said plug assembly further includes a sleeve attached to said plug body; said portion of said plug assembly which is keyed is said sleeve.

18. A connector as set forth in claim 16, wherein said plug body is also keyed so as to permit the insertion of said plug body into a jack body which is wired in said preselected nonstandard wiring configuration.

19. A keyed modular connection system comprising:

a preselected nonstandard wiring configuration;

a plug assembly, including a plug body and a sleeve; said plug body wired in a preselected nonstandard wiring configuration and comprising plug body exterior surfaces; at least one of said plug body exterior surfaces defining a plug body recess;

said sleeve having sleeve exterior surfaces; at least one of said sleeve exterior surfaces having a sleeve protrusion;

a jack assembly including a jack body and a bezel; said jack body wired in said preselected nonstandard wiring configuration and comprising jack body interior surfaces; at least one of said jack body interior surfaces having a jack body protrusion; said bezel having bezel interior surfaces; at least one of said bezel interior surfaces defining a bezel recess; said sleeve protrusion configured to be received by said bezel recess when said plug body is inserted into said jack body; said jack body protrusion configured to be received by said plug body recess when said plug body is inserted into said jack body; whereby when a plug not wired in said preselected nonstandard wiring configuration is attempted to be inserted into said jack body, said jack body protrusion prevents the attempted insertion and when said plug body is attempted to be inserted into a jack not wired in said preselected nonstandard wiring configuration, said plug body protrusion prevents the insertion.

20. A modular connection system as set forth in claim 19, wherein the jack body and said plug body each have an ordered array of first, second, third, fourth, fifth, sixth, seventh and eighth conductors, including first, second, third, and fourth conductor pairs.

21. A modular connection system as set forth in claim 20, wherein said preselected nonstandard wiring configuration is defined by said first and second conductors being said second conductor pair, said third and fourth conductors being said first conductor pair, said fifth and sixth conductors being said third conductor pair, arid said seventh and eighth conductors being said fourth conductor pair.

22. A modular connection system as set forth in claim 20, wherein said preselected nonstandard wiring configuration is defined by first and second conductors being said second conductor pair, said third and fourth conductors being said third conductor pair, said fifth and sixth conductors being said first conductor pair, and said seventh and eighth conductors being said fourth conductor pair.

23. A modular connection system as set forth in claim 20, wherein said preselected nonstandard wiring configuration is defined by said first and second conductors being said third conductor pair, said third and fourth conductors being said first conductor pair, said fifth and sixth conductors being said second conductor pair, and said seventh and eighth conductors being said fourth conductor pair.

24. A modular connection system as set forth in claim 20, wherein said preselected nonstandard wiring configuration is defined by said first and second conductors being said first conductor pair, said third and fourth conductors being said second conductor pair, said fifth and sixth conductors being said third conductor pair, and said seventh and eighth conductors being said fourth conductor pair.

25. A keyed modular connection system comprising:

a preselected nonstandard wiring configuration;

a plug wired in said preselected nonstandard wiring configuration and comprising two exterior surfaces, each of said two exterior surfaces defining a plug recess;

a jack wired in said preselected nonstandard wiring configuration and comprising two interior surfaces, each of said two interior surfaces defining a jack recess;

two plug protrusions extending from said two exterior surfaces of the plug; said two plug protrusions configured to be received by said two jack recesses when said plug is inserted into said jack;

two jack protrusions extending from said interior surfaces of said jack; said two jack protrusions configured to be received by said two plug recesses when said plug is inserted into said jack;

wherein when a plug not wired in the preselected nonstandard wiring configuration is attempted to be inserted into said jack, said jack protrusions prevent the attempted insertion, and when said plug is attempted to be inserted into a jack not wired in the preselected nonstandard wiring configuration, said plug protrusions prevent the attempted insertion.

* * * * *